US005919057A

United States Patent [19]

Kameyama

[11] Patent Number: 5,919,057

[45] Date of Patent: Jul. 6, 1999

[54] REMOVABLE MAIN CONNECTOR

[75] Inventor: Isao Kameyama, Shizuoka, Japan

[73] Assignee: Yazaki Corporation, Tokyo, Japan

[21] Appl. No.: 08/870,680

[22] Filed: Jun. 6, 1997

[30] Foreign Application Priority Data

Jun. 7, 1996 [JP] Japan ..... 8-146228

[51] Int. Cl.[6] ..... H01R 13/627

[52] U.S. Cl. ..... 439/364; 439/542

[58] Field of Search ..... 439/364, 248, 439/247, 542, 567

[56] References Cited

U.S. PATENT DOCUMENTS

| | | | |
|---|---|---|---|
| 5,711,630 | 1/1998 | Kodama | 439/364 |
| 5,813,880 | 9/1998 | Kodama | 439/364 |
| 5,829,910 | 11/1998 | Kameyama | 439/364 |
| 5,836,787 | 11/1998 | Kodama | 439/567 |

FOREIGN PATENT DOCUMENTS 1-17827 5/1989 Japan .

*Primary Examiner*—Gary Paumen
*Assistant Examiner*—Antoine Ngandjui
*Attorney, Agent, or Firm*—Sughrue, Mion, Zinn, Macpeak & Seas, PLLC

[57] ABSTRACT

A main connector (31) which is provided on a car body (37) and is attachable to an insertion-side connector (53) provided on an instrument panel (51). A holding shaft (39*b*) projects from a car body (37). The main connector (31) includes a movable bracket (35) and a connector body (33) attached to the movable bracket. A holding-shaft insertion hole (35*g*) is formed in the movable bracket (35) so that the holding shaft (39*b*) is loosely fitted in the hole. Flexible lock arms (49) are provided on the holding shaft (39*b*) for temporarily locking the movable bracket (35) on the holding shaft (39*b*). When the insertion-side connector is fitted to the main connector (31), the movable bracket (35) is separated from the holding shaft (39*b*), releasing the fixed relationship between the movable bracket (35) and the holding shaft (39*b*). As a result, no load is exerted on the terminal contact between the insertion-side connector (53) and the main connector (31) due to vibrations of the car body. Therefore, the reliability of the electrical connection is improved.

7 Claims, 4 Drawing Sheets

REMOVABLE MAIN CONNECTOR

BACKGROUND OF THE INVENTION

1. Field of the Invention

The present invention generally relates to a connector and particularly relates to a connector (hereinafter, referred to as a main connector) which is provided on a main body so as to be fitted to an insertion-side connector provided on an assembly in an assembling structure for attaching the assembly on the main body.

2. Description of the Related Art

Electrical connection between electric parts provided on an assembly, for example, an instrument panel and a car body side is performed by fitting an insertion-side connector provided on the rear surface of the instrument panel to a main connector provided on a main body, for example, a car body. Although the insertion-side connector and the main connector are designed so that their insertion central axes are coincident with each other when the instrument panel is attached in a predetermined position on the car body, there is a case where displacement is generated between the insertion central axes of the respective connectors because of dimensional tolerance or the like, thereof.

Referring to FIG. 5, description will be made as to an example of the main connector of this kind which is movably provided on a car body to thereby make it possible to absorb a fitting error with an insertion-side connector. FIG. 5 is a side view showing an insertion-side connector and a conventional main connector. A main connector 1 is provided with a connector body 3 attached to a movable bracket 5. The movable bracket 5 holds the connector body 3 through locking between flexible lock pawls 7 of the movable bracket 5 and lock protrusions 9 of the connector body 3, respectively. Further, the movable bracket 5 is attached to a car body 13 through locking between lock pawls 11 of the movable bracket 5 and lock portions 15 of the car body 13, respectively. Therefore, the connector body 3 is movable relative to the car body 13 within a range of elastical displacement of the flexible lock pawls 7. A shaft portion 17 having an opening at its front end is projected from the front surface of the connector body 3 and a nut 19 is provided in the inside of the shaft portion 17.

An insertion-side connector 23, on the other hand, is attached to the rear surface of an instrument panel 21. A receiving hole 25 is formed in the insertion-side connector 23 so that the shaft portion 17 is inserted into the hole 25. A rotatable bolt 27 is provided in the receiving hole 25 so that the bolt 27 can be screwed into the nut 19 of the main connector 1.

In the thus configured main connector 1, if there is a fitting error between the insertion-side connector 23 and the main connector 1 when the instrument panel 21 is attached in the predetermined position of the car body 13, the shaft portion 17 of the main connector 1 may be movable along the receiving hole 25 of the insertion-side connector 23 and this possibility of movement of the shaft portion 17 is absorbed by the flexible lock pawls 7 of the movable bracket 5 so that the main connector 1 moves on the same insertion central axis as that of the insertion-side connector 23.

After the shaft portion 17 is inserted into the receiving hole 25, the bolt 27 is screwed into the nut 19 so that the main connector 1 which has moved on the same insertion central axis is drown toward the insertion-side connector 23 and a terminal 29*a* of the main connector 1 is connected to a terminal 29*b* of the insertion-side connector 23 to thereby complete the fitting between the main connector 1 and the insertion-side connector 23.

In the conventional main connector 1, however, there is such a possibility that since the connector body 3 is attached on the car body 13 through the movable bracket 5 so as to be held thereon, relative displacement or resonance is generated between the car body 13 and the instrument panel 21 when vibration is generated in running of the car so that a load is exerted to a contact portion between the terminals 29*a* and 29*b* of the main connector 1 and the insertion-side connector 23 to make the contact state unstable to thereby reduce the reliability of the electrical connection.

SUMMARY OF THE INVENTION

An object of the present invention is to solve the foregoing conventional problem and to provide a main connector in which no influence is given to a terminal contact portion even when relative displacement is generated between an assembly and a main body by vibration or the like in running and in which the reliability of the electrical connection structure in a connector is improved.

In order to achieve the above object, according to the present invention, there is provided a main connector comprising: a holding shaft projected from a main body; a movable bracket on which a connector body is attached; a holding-shaft insertion hole formed in the movable bracket so that the holding shaft is loosely fitted into the hole; and a flexible lock arm provided between the holding-shaft insertion hole and the holding shaft so as to movably and removably lock the movable bracket on the holding shaft.

DETAILED DESCRIPTION OF THE PREFERRED EMBODIMENT

A preferred embodiment of the main connector according to the present invention will be described below in detail with reference to the accompanied drawings.

Figure 1:
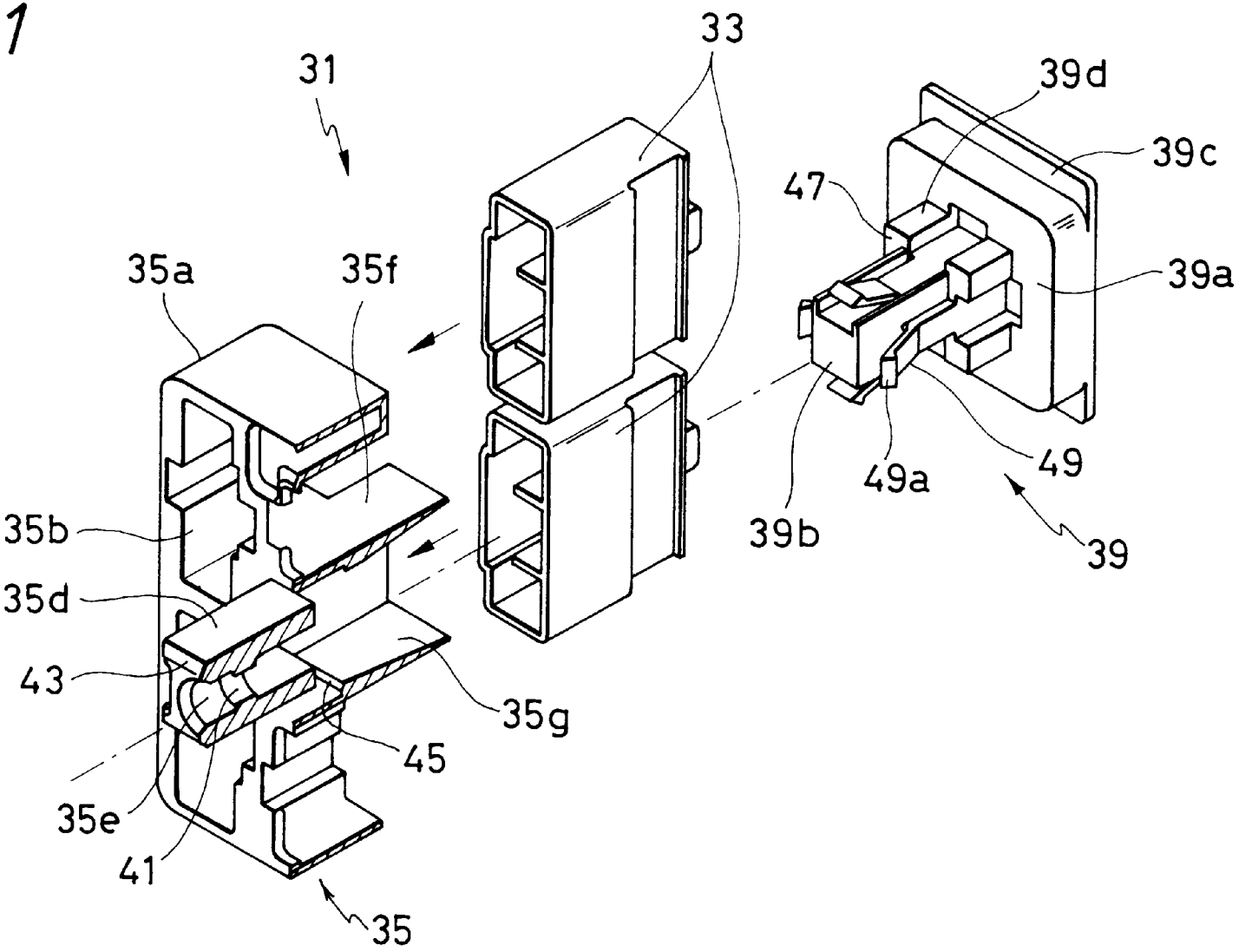
FIG. 1 is an exploded perspective view showing an embodiment of the main connector according to the present invention.
Figure 2:
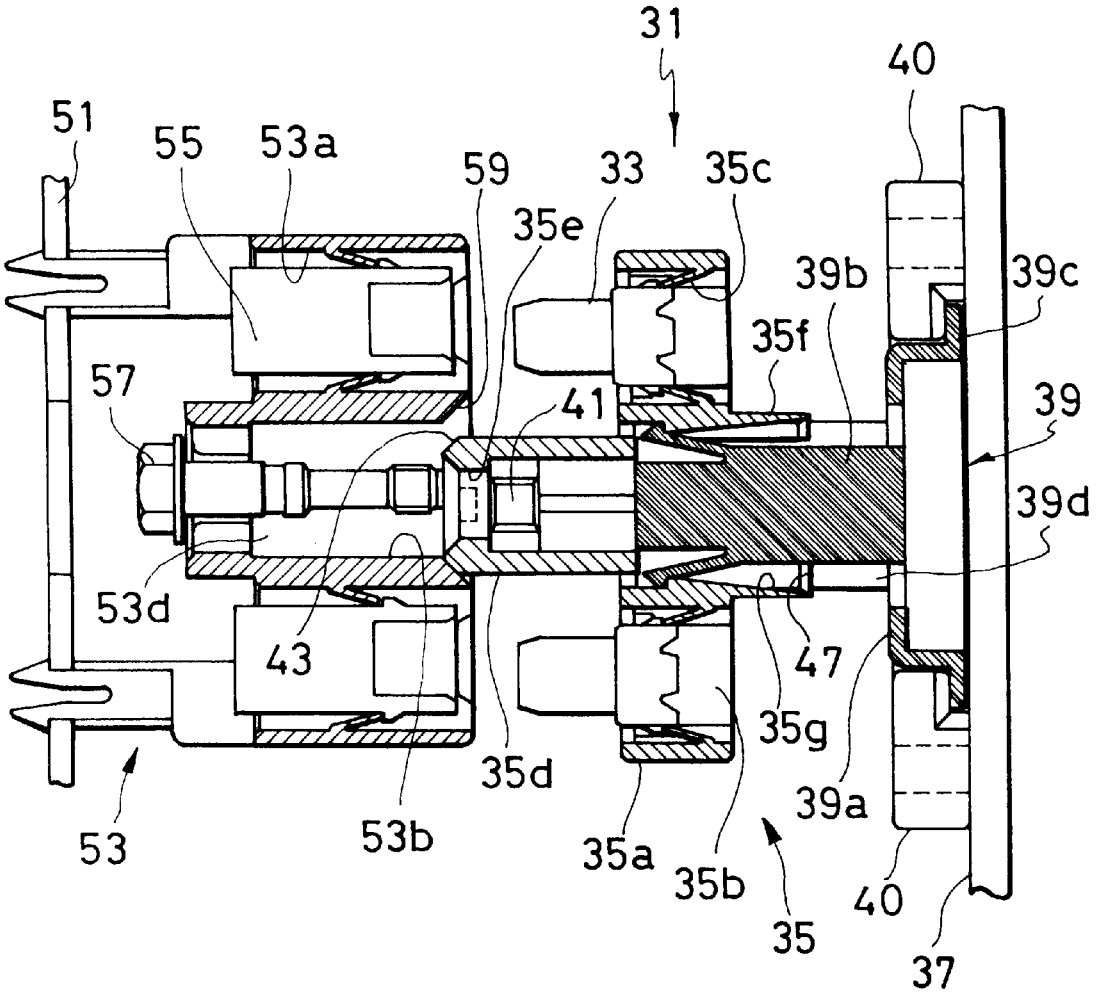
FIG. 2 is a sectional view showing an insertion-side connector and the main connector according to the present invention.
Figure 3:
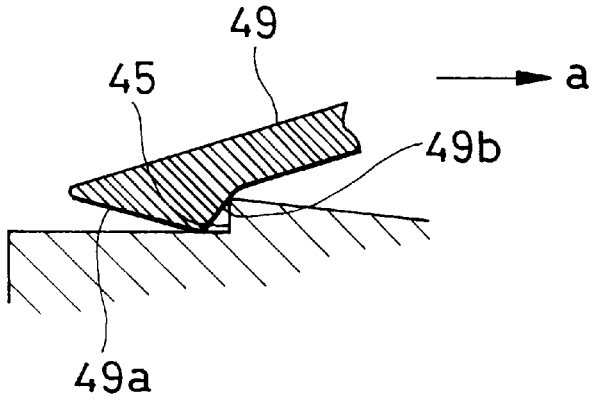
FIG. 3 is an enlarged sectional view showing a flexible lock arm in the main connector of FIG. 1.

FIG. 1 is an exploded perspective view showing an embodiment of the main connector according to the present invention; FIG. 2 is a sectional view showing an insertion-side connector and the main connector according to the present invention; and FIG. 3 is an enlarged sectional view showing a flexible lock arm in the main connector of FIG. 1. In this embodiment, a main connector 31 includes a movable bracket 35 in which connector bodies 33 are attached, and a holding table 39 for holding the movable bracket 35 on a car body 37 which is a main body.

Connector holding holes 35*b* are formed in a body portion 35*a* of the movable bracket 35 so as to be opened in the front and rear surfaces of the body portion 35*a*. The connector bodies 33 are inserted into the connector holding holes 35*b* from the rear surface side of the body portion 35*a*. The connector holding holes 35*b* hold the connector bodies 33 in a state so that the front portions of the connector bodies 33 project from the connector holding holes 35*b*, and the connector bodies 33 are prevented, by means of lock pawls 35*c*, from coming off backward.

An insertion shaft 35*d* is provided at the center of the body portion 35*a* so as to project forward. The insertion shaft 35*d* has a bolt insertion hole 35*e* with its front end opened. A nut 41 is provided in the inside of the bolt insertion hole 35*e* so that the screwing central axis of the nut 41 is made to coincide with the central axis of the insertion shaft 35*d*. Further, a tapered guide surface 43 with its corners cut off is formed on a front end outer circumference of the insertion shaft 35*d*.

A pipe-like portion 35*f* with its rear end opened is provided at the center of the rear surface of the body portion 35*a*, and an inside space of the pipe-like portion 35*f* forms a holding-shaft insertion hole 35*g*. In this embodiment, the pipe-like portion 35*f* is constituted by a rectangular pillar and lock portions 45 are formed on the inner surface walls on four sides of the holding-shaft insertion hole 35*g*.

On the other hand, the holding table 39 has a holding shaft 39*b* which is provided on one surface of a base plate portion 39*a* so as to project therefrom and perpendicularly thereto. The holding table 39 is to be fixed on the car body 37. For example, the fixing structure therefor includes: a structure in which flange portions 39*c* are provided on the opposite sides of the base plate portion 39*a* so as to project therefrom and slide-inserted between a pair of holding rails 40 fixed on the car body 37 so that the holding table 39 is fixed to the car body 37; a structure in which the base plate portion 39*a* is fixed directly on the car body 37 by means of screws; and so on.

In this embodiment, the holding shaft 39*b* is provided in the form of a rectangular pillar. The holding shaft 39*b* is designed so as to be inserted into the holding-shaft insertion hole 35*g* of the movable bracket 35. The holding shaft 39*b* is formed so as to have an outer shape smaller than the size of the holding-shaft insertion hole 35*g* so that the holding shaft 39*b* can move freely in the holding-shaft insertion hole 35*g* when the holding shaft 39*b* enters into the latter.

Further, pedestal portions 39*d* having abutment surfaces 47 which are planes perpendicular to the side surfaces of the holding shaft 39*b* are provided in the circumference of the base portion of the holding shaft 39*b*. When the movable bracket 35 is pressed against an insertion-side connector 53 which will be described later at the time of connector fitting, the rear end of the pipe-like portion 35*f* abuts on the abutment surfaces 47 of the pedestal portions 39*d* so that the movable bracket 35 is prevented from being inclined. That is, the insertion central axis of the movable bracket 35 which has abutted on the pedestal portions 39*d* is always held to be parallel to that of the insertion-side connector 53.

Flexible lock arms 49 are formed on the respective side walls of the holding shaft 39*b* at the front end side thereof. The flexible lock arms 49 are fixed at their base ends on the respective side surfaces of the holding shaft 39*b*, and the front ends of the respective flexible lock arms 49 which are free ends project in the direction toward the front end of the holding shaft 39*b* so that the flexible lock arms 49 are separated from the respective side surfaces of the holding shaft 39*b*. That is, the front ends of the respective flexible lock arms 49 can approach to and separate from the side surfaces of the holding shaft 39*b* when the flexible lock arms 49 elastically transform. Lock pawls 49*a* are formed on the front ends of the respective flexible lock arms 49 so as to project outside.

When the holding shaft 39*b* is inserted in the holding-shaft insertion hole 35*g*, the lock pawls 49*a* of the respective flexible lock arms 49 are locked by the lock portions 45 provided on the respective inner walls of the holding-shaft insertion hole 35*g*. As shown in FIG. 3, the lock pawl 49*a* of the flexible lock arm 49 constitutes a so-called semi-lock type lock pawl in which a pawl back surface 49*b* of the lock arm 49 is slightly inclined so that the lock between the lock arm 49 and the lock portion 45 can be released by application of a predetermined force in the removing direction (in the direction of an arrow a in FIG. 3).

Further, the movable bracket 35 is configured such that the rear end of the pipe-like portion 35*f* abuts on the abutment surfaces 47 of the respective pedestal portions 39*d* in the state where the lock pawls 49*a* of the respective flexible lock arms 49 are locked by the lock portions 45. Therefore, in the movable bracket 35, a load applied from the front side thereof can be borne by the abutment surfaces 47 in this state.

An instrument panel 51 which is an assembly, on the other hand, has the insertion-side connector 53 attached thereon, as shown in FIG. 2. In the insertion-side connector 53, connector bodies 55 are mounted in connector receiving chambers 53*a*. An insertion-shaft receiving hole 53*b* is formed in a central portion of the insertion-side connector 53 and a rotatable bolt 57 is inserted into the center of the insertion-shaft receiving hole 53*b*. A guide surface 59 is formed in an opening portion of the insertion-shaft receiving hole 53*b* and constituted by a tapered surface reduced in diameter from the inlet side of the hole toward the depth side of the same.

Description will be made as to the attachment procedure of the main connector 31 having such a configuration as described above.

First, the connector bodies 33 are attached into the connector holding holes 35*b* of the movable bracket 35. Thereafter, the front end of the holding shaft 39*b* of the holding table 39 is inserted into the holding-shaft insertion hole 35*g* of the movable bracket 35 from its rear end. The flexible lock arms 49 of the holding shaft 39*b* inserted into the holding-shaft insertion hole 35*g* are bent by the inner walls of the holding-shaft insertion hole 35*g* and elastically returned so as to be locked on the lock portions 45 when the lock arms 49 have reached the lock portions 45. At the same time, the rear end surface of the pipe-like portion 35*f* abuts on the abutment surfaces 47 of the holding table 39 so that the flexible lock arms 49 are held on the holding table 39.

The main connector 31 is fixed on the car body 37 by means of the foregoing fixing structure in this state. As a result, attachment of the main connector 31 onto the car body 37 is completed.

Figure 4A:
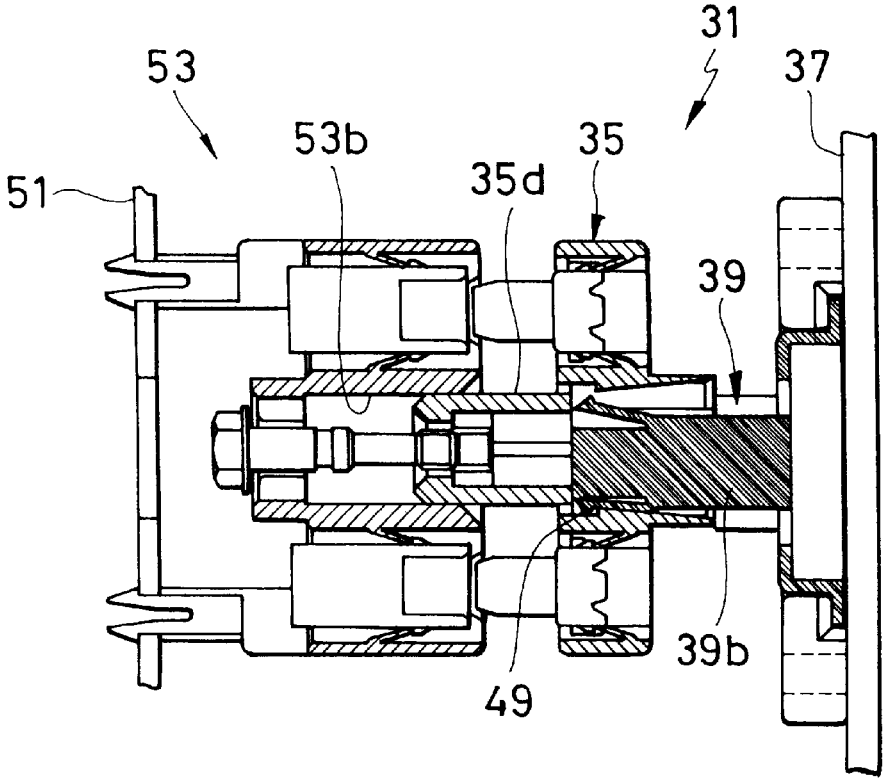
FIGS. 4(A) and 4(B) are sectional views for explaining the operation of the main connector according to the present invention, showing states at the beginning of fitting and upon completion of fitting, respectively.
Figure 4B:
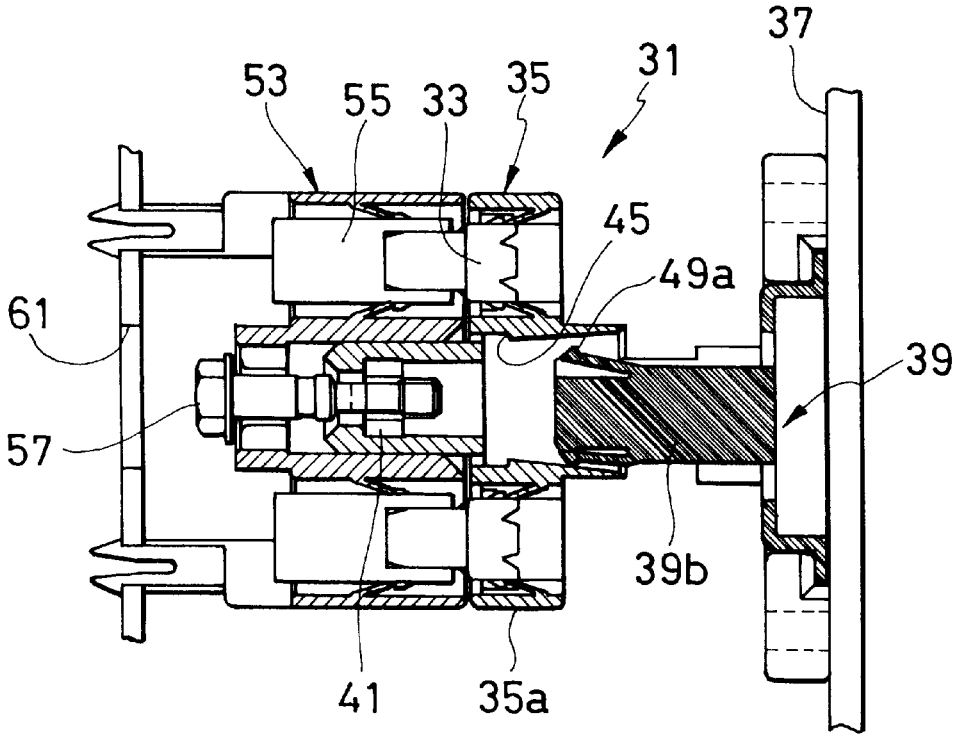
Figure 5:
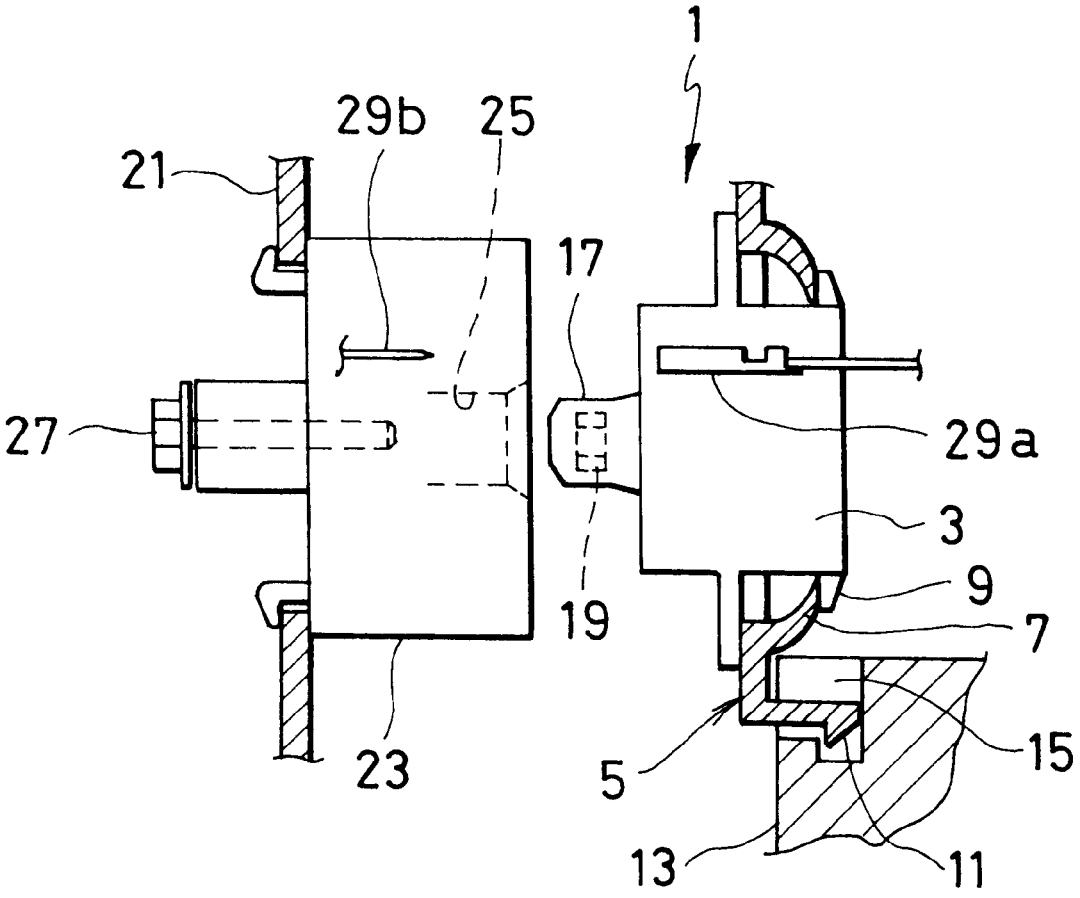
FIG. 5 PRIOR ART
FIG. 5 is a side view showing an insertion-side connector and a conventional main connector.

Next, referring to FIGS. 2, 4(A) and 4(B), description will be made as to the operation of the main connector 31 attached on the car body 37 as described above. FIGS. 4(A) and 4(B) are sectional views for explaining the operation of the main connector according to the present invention, showing the states at the beginning of fitting and upon completion of the fitting, respectively. When the insertion-side connector 53 attached on the rear surface of the instrument panel 51 and the main connector 31 attached on the car body 37 are to be fitted to each other, the instrument panel 51 is fixed on the car body 37 in a predetermined position.

At this time, if there is any positional displacement between the insertion-side connector 53 and the main connector 31, the front end of the insertion shaft 35*d* of the main connector 31 abuts on the guide surface 59 of the insertion-side connector 53.

When the instrument panel 51 is made to approach more to the car body 37 in this state, the insertion shaft 35*d* of the main connector 31 moves along the guide surface 59 so that the insertion central axis of the main connector 31 coincides with that of the insertion-side connector 53 and the insertion shaft 35*d* enters the insertion-shaft receiving hole 53*b* as shown in FIG. 4(A).

At this time, although the movable bracket 35 moves parallelly in the direction perpendicular to the insertion central axis, the flexible lock arms 49 of the holding table 39 bend to thereby absorb the movement. Therefore, while the movable bracket 35 moves relative to the holding shaft 39*b* in this state, the flexible lock arms 49 bend so that the holding by the holding shaft 39*b* is kept as it is.

After completion of attachment of the instrument panel 51, as shown in FIG. 4(B), the bolt 57 is fastened from the front surface side of the instrument panel 51 through a hole 61 opened in the instrument panel 51 so as to be screwed into the nut 41 of the main connector 31 so that the whole of the movable bracket 35 is drawn toward the insertion-side connector 53. The lock between the lock portions 45 and the semi-lock system lock pawls 49*a* is released by the drawing force so that the movable bracket 35 is removed from the holding shaft 39*b* of the holding table 39.

By completion of screwing of the bolt 57, the movable bracket 35 is perfectly fitted to the insertion-side connector 53 and the connector bodies 33 attached on the body portion 35*a* are fitted into the connector bodies 55 of the insertion-side connector 35 to thereby complete the electrical connection. Therefore, the movable bracket 35 becomes in a state that the movable bracket 35 is integrally connected with the insertion-side connector 53 while the holding state by means of the holding shaft 39*b* is released. That is, the connection of the movable bracket 35 with the car body 37 is cut because the holding relation between the movable bracket 35 and the car body 37 is released.

Although the movable bracket 35 and the connector bodies 33 are provided as separate parts in the foregoing embodiment, the main connector 31 may be configured such that the movable bracket 35 and the connector bodies 33 are formed as an integral part.

According to such an integral structure of the movable bracket 35 and the connector bodies 33 as described above, it is possible to reduce the number of parts of the main connector 31.

As described above in detail, in the main connector according to the present invention, the movable bracket is movably and removably held on the holding table so that when the assembly on which the insertion-side connector is attached is fixed on the main body, the movable bracket can be moved to absorb an assembling error with the insertion-side connector. Further, after fitting to the insertion-side connector, the movable bracket can be separated from the holding table to thereby release the fixing relation between the movable bracket and the main body. As a result, even if there occurs any positional displacement between the assembly and the main body due to vibration or the like, no load is exerted on the terminal contact between the insertion-side connector and the main connector, and the reliability of the electrical connection structure can be improved.

Further, in the main connector in which the holding shaft is provided with the pedestal portion which abuts on the rear end surface of the movable bracket, when the main connector is pressed against the insertion-side connector at the time of connector fitting, the movable bracket abuts on the pedestal portion so as to be prevented from being inclined. As a result, the respective insertion central axes of the insertion-side connector and the main connector are always parallel to each other and the connector fitting property can be made good.

Moreover, when the connector body and the movable bracket are integrally formed with each other, it is not necessary to form the movable bracket as a separate part so that the main connector can be constituted by parts the number of which is small.

What is claimed is:

1. A removable main connector comprising:

a holding shaft projected form a main body;

a connector body;

a movable bracket to which said connector body is secured, said movable bracket having a holding-shaft insertion hole formed therein for receiving said holding shaft and;

a flexible locking member associated with one of said holding shaft and said movable bracket and engageable with the other of said holding shaft and said movable bracket for removably locking said movable bracket on said holding shaft;

wherein upon engagement of a mating connector body with said connector body, said flexible locking member is forcibly disengaged so that said movable bracket is released from said holding shaft.

2. The removable main connector according to claim 1, wherein said flexible lock arm is formed on a side surface of said holding shaft at a front end side thereof.

3. The removable main connector according to claim 2, wherein a base end of said flexible lock arm is fixed on the side surface of said holding shaft, and a front end thereof which is a free end projects in a direction toward the front end side of said holding shaft so that said flexible lock arm is separated from the side surface of said holding shaft.

4. The removable main connector according to claim 3, wherein a lock pawl is formed on a front end of said flexible lock arm so as to project outside so that said lock pawl is locked by a lock portion provided on an inner wall of said holding-shaft insertion hole.

5. The removable main connector according to claim 1, wherein a pedestal portion is provided on said holding shaft so as to abut on a rear end surface of said movable bracket which is in a state that said movable bracket is inserted on said holding shaft to thereby prevent inclination of said movable bracket.

6. The removable main connector according to claim 1, wherein said connector body and said movable bracket are integrally formed with each other.

7. A removable main connector comprising:

a holding shaft projected from a main body;

a first connector body;

a movable bracket to which said first connector body is secured, said movable bracket having a holding-shaft insertion hole formed therein for receiving said holding shaft;

a flexible locking member associated with one of said holding shaft and said movable bracket and engageable with the other of said holding shaft and said movable bracket for removably locking said movable bracket on said holding shaft; and a second connector body provided on an instrument panel, said second connector body being engageable with said movable bracket, wherein upon the fitting and engagement of said second connector body with said movable body, said flexible locking member is disengaged so that said movable bracket is detached from said holding shaft.

* * * * *